United States Patent [19]

Schirmer

[11] Patent Number: 5,020,922

[45] Date of Patent: Jun. 4, 1991

[54] BONE PUNCTURE RESISTANT BAG

[75] Inventor: Henry G. Schirmer, Spartanburg, S.C.

[73] Assignee: W. R. Grace & Co.-Conn., Duncan, S.C.

[21] Appl. No.: 316,588

[22] Filed: Mar. 6, 1986

Related U.S. Application Data

[63] Continuation of Ser. No. 704,158, Feb. 22, 1985, abandoned, which is a continuation of Ser. No. 509,492, Jun. 30, 1983, abandoned.

[51] Int. Cl.[5] ..... B65D 30/10

[52] U.S. Cl. ..... 383/119; 206/484; 383/109; 383/122; 383/124; 426/127; 426/129

[58] Field of Search ..... 383/38, 109, 119, 121–124; 426/127, 129; 206/484, 524.8, 497; 493/189, 198, 193–196, 209, 254

[56] References Cited

U.S. PATENT DOCUMENTS

| | | | |
|---|---|---|---|
| 1,027,168 | 5/1912 | Bartlett | 493/243 |
| 2,593,608 | 4/1952 | Rambold | 383/38 |
| 2,623,441 | 12/1952 | Rose et al. | 493/197 |
| 2,837,979 | 6/1958 | Vilutis | 493/209 X |
| 3,259,301 | 7/1966 | Onasch | 383/114 |
| 3,550,839 | 12/1970 | Clayton et al. | 383/119 X |
| 3,869,842 | 3/1975 | Verbeke | 493/209 X |
| 3,908,522 | 9/1975 | Bender | 493/194 |
| 4,136,205 | 1/1979 | Quattlebaum | 426/127 |
| 4,182,222 | 1/1980 | Stahl | 493/196 |
| 4,239,111 | 12/1980 | Conant et al. | 426/127 |
| 4,267,960 | 5/1981 | Lind et al. | 383/119 |

*Primary Examiner*—Bryon P. Gehman

*Attorney, Agent, or Firm*—John J. Toney; William D. Lee, Jr.; Mark B. Quatt

[57] ABSTRACT

A seamless, bone puncture resistant bag is provided that representatively includes a length of lay-flat seamless tubular film folded to a double lay-flat configuration and having all adjacent film surfaces interfacially bonded, respectively, except at one outermost interface. The configuration thus forms a seamless envelope with one face thickened integrally to triple thickness. In a less preferred mode, a similarly reinforced bag is provided but which has either an end-seal or side-seals. Associated methods for making such bags are also provided.

2 Claims, 3 Drawing Sheets

BONE PUNCTURE RESISTANT BAG

This application is a continuation of application Ser. No. 704,158 filed on Feb. 22, 1985, now abandoned, which is a continuation of application Ser. No. 509,492 filed on June 30, 1983, now abandoned.

BACKGROUND OF THE INVENTION

This invention relates generally to puncture resistant packaging for meat articles having sections of protruding bone and specifically to thermoplastic packaging bags having a reinforced side adapted to confront such bone sections of a contained meat article.

In vacuum packaging of primal meat cuts having protruding bones, a problem frequently encountered concerns puncture of the packaging film by the sharp ends of such bones thereby defeating the oxygen barrier effect of the film. The term "bone puncture resistant bag" is conventionally used to refer to a thermoplastic packaging bag having a reinforced side against which are directed bone ends of a contained primal meat cut.

One approach to making a bone puncture resistant bag is to provide a reinforcing layer within the bag so that primal meat cuts may be inserted into the bag with protruding bones confronting the reinforcing sheet. An example of this approach is shown in U.S. Pat. No. 4,136,205 for "Container and Method for Packaging Meat Articles" issued Jan. 23, 1979 to Quattlebaum, wherein a mesh reinforcing sheet is heat sealed to one interior face of a thermoplastic bag to facilitate complete vacumizing of the bag and thereby to enhance conformability of the vacuum sealed bag to a contained primal meat product.

Another approach to bag reinforcement is shown in U.S. Pat. No. 4,239,111 for "Flexible Pouch with Cross-Oriented Puncture Guard" issued Dec. 16, 1980 to Conant et al, wherein a puncture guard is bonded to an exterior face of a heat-sealable bag, the guard being composed of a plurality of oriented resin sheets which are laminated in cross-oriented relationship to each other.

An additional problem in such packaging concerns the integrity of heat seals incorporated in the manufacture of such bags. For example, either end-sealed or side-sealed bags are made by heat sealing tubular film at regular intervals, bag production from seamless tubular film being commercially advantageous. However, it is frequently a problem that these heat seals do not withstand the abuse encountered in handling vacuum packaged primal meat cuts.

SUMMARY OF THE INVENTION

It is a primary object of the present invention to provide a bone puncture resistant bag that does not require the addition of a separate reinforcing member apart from manufacture of the bag envelope. It is a further object of the invention to provide a bone puncture resistant bag that is seamless, i.e. the product containing envelope of the bag is seamless except of course at the mouth of the bag.

Accordingly, a seamless, puncture resistant bag is provided that includes a length of lay-flat seamless tubular film folded to at least a double lay-flat configuration and having all adjacent film surfaces interfacially bonded, respectively, except at one open-ended interface, preferably an outermost interface. The configuration thus forms a seamless envelope with at least one face thickened integrally to at least triple thickness.

Additionally, a method for making a seamless, puncture resistant bag is provided that includes folding a length of lay-flat seamless tubular film to at least a double lay-flat configuration and interfacially bonding all adjacent film surfaces, respectively, except at one open-ended interface, preferably an outermost interface.

Preferably, the method is applied in a continuous operation, for example, by advancing a lay-flat seamless tube of thermoplastic film; internally fusing the lay-flat tube periodically at and along intervals equal to about the desired bag length; treating an external surface of the lay-flat tube to render the surface self-adherent; and periodically, corresponding to said intervals, folding back the lay-flat tube, toward its adherently treated surface, at the juncture between the leading fused-unfused segments of the lay-flat tube; followed by pressing the thus folded portion of the lay-flat tube and severing it therefrom.

In a less preferred variant of the invention, a similarly reinforced bag is provided but which has either an end-seal or side seals. Such bag includes a length of lay-flat tubular film folded along its longitudinal axis and having all adjacent film surfaces interfacially bonded, respectively, except at one outermost interface, said tube being sealed at one end or sealed at both ends with a cut along the collapsed edge of the lay-flat tube which is adjacent the unbonded interface.

BRIEF DESCRIPTION OF THE DRAWINGS

Further details are given below with reference to the drawings wherein.

DESCRIPTION OF THE PREFERRED EMBODIMENTS

Figure 1:
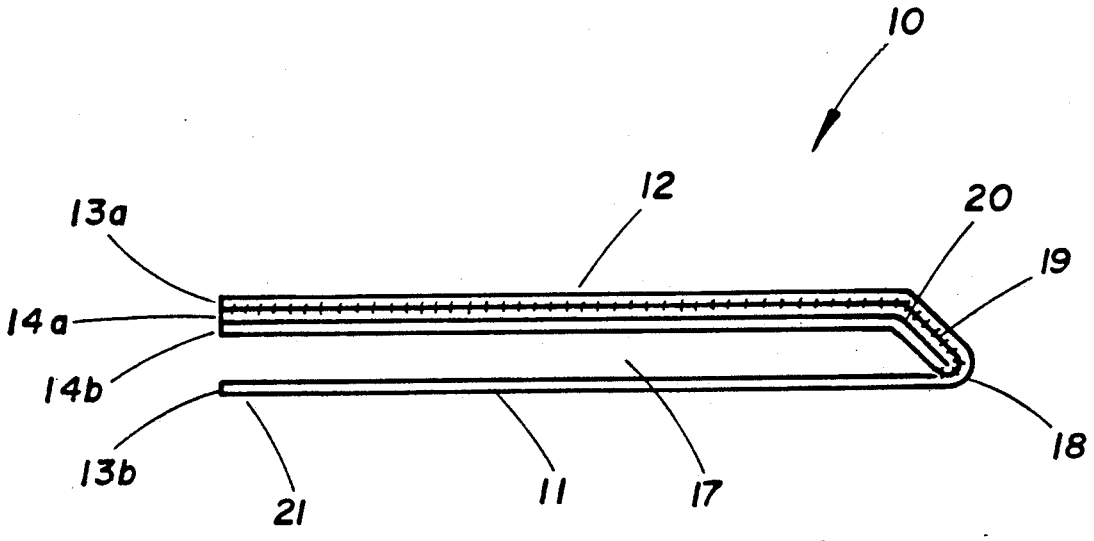
FIG. 1 is a schematic cross-sectional view taken lengthwise of a preferred bone puncture resistant bag of the invention.

Referring more particularly to the drawings, in FIG. 1 there is shown a schematic cross-sectional view taken lengthwise of a preferred bone puncture resistant bag according to the invention. The bag 10 is composed of conventional tubular thermoplastic packaging film which is heat sealable, such as film disclosed in U.S. Pat. No. 3,741,253 for "Laminates of Ethylene Vinyl Acetate Polymers and Polymers of Vinylidene Chloride" issued June 26, 1973 to Brax et al. Bag 10 has a single thickness panel 11 and a triple thickness panel 12 with a product containing envelope 17 lying therebetween. Bag 10 is formed by folding a length of lay-flat tubing back onto itself, the original length of the lay-flat tubing being approximately equal to twice the length of panel 11. Upon folding the length of lay-flat tubing widthwise in the vicinity of 18, a seamless bag bottom is formed at 18. The original walls of the lay-flat tubing are indicated by reference numerals 13 and 14 with the suffixes a,b referring to the folded and unfolded segments, respectively. After folding back the length of lay-flat tubing onto itself, triple thickness panel 12 is formed by bonding all interfaces within panel 12, i.e. interfaces 19 and 20. Interface 19 is bonded by fusing together the internal surfaces of the lay-flat tubing, prior to folding, along the segment corresponding to panel 12, which is readily accomplished since the film material is heat sealable. Bonding at interface 20 results by virtue of selected treatment that renders the corresponding outside surface of the lay-flat tubing self-adherent, such as corona treatment or application of a tacky coating. Thus, triple thickness panel 12 forms the puncture guard of bag 10. Product containing envelope 17 is seamless at bag bottom 18 by virtue of the folded configuration and seamless along its sides by virtue of the bag being formed from seamless tubular film. Thus, the puncture resistant bag as shown is composed of a length of lay-flat seamless tubular film folded to a double lay-flat configuration with all adjacent film surfaces interfacially bonded, respectively, except at one outermost interface which delimits a product containing envelope.

In use, a primal meat cut is loaded into envelope 17 and oriented in such a way that protuding bone sections confront panel 12. In conventional fashion, the loaded bag is then vacuumized and heat sealed at its open mouth end while still under vacuum. Alternatively, bag closure can be accomplished by gathering and clipping the bag mouth while under vacuum. In the preferred mode, the bag is heat-shrinkable, i.e. of oriented film, so that following vacuum closure the bag is heat-shrunk about the contained meat product. It is a further feature of the invention that even though substantial heat-shrinkage preliminarily takes place in the puncture guard panel during fusing of interface 19, integrity of bonded interface 20 is maintained during heat-shrinkage of the bag on the contained product.

Figure 4:
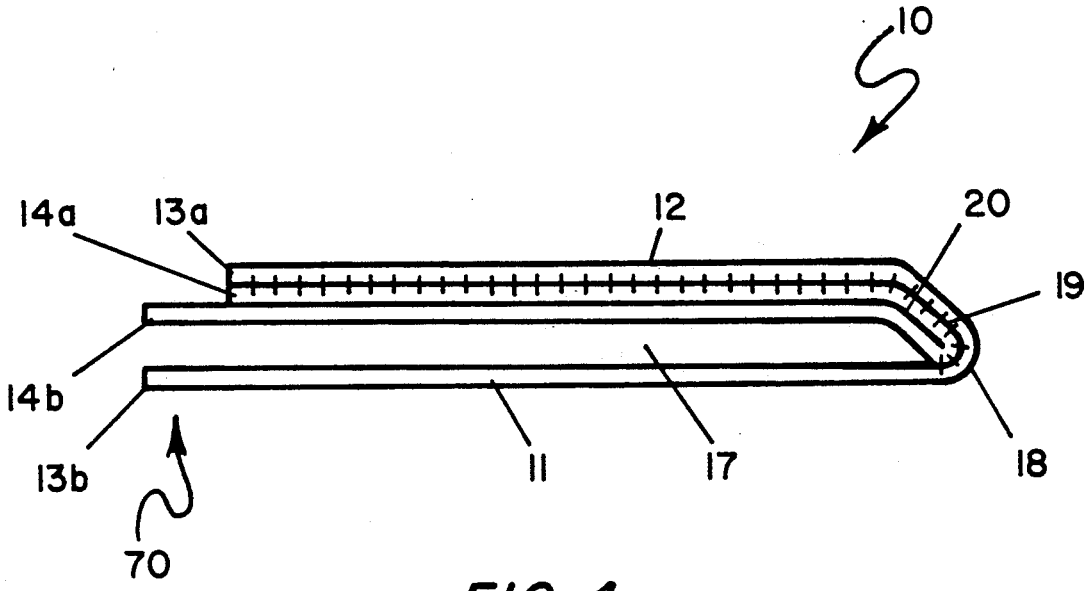
FIG. 4 is a schematic cross-sectional view taken lengthwise of another preferred bone puncture resistant bag in accordance with the present invention.

Optionally, a heat sealing lip may be provided on the bag by internally fusing and folding the original length of lay-flat tubing asymmetrically so that the unfused segment of the lay-flat tubing is longer than the fused segment with folding being done at the juncture between the fused-unfused segments. For example, segments **13*b* and 14*b* of bag 10 would be longer than segments 13*a* and 14*a*, thereby extending the bag mouth beyond the puncture guard to form a heat sealing lip 70 (See FIG. 4**).

Optionally, panel 12 may be thickened to greater than triple thickness by folding the fused segment of lay-flat tubing in a sinuous pattern, the respective lengths of the fused-unfused segments of the lay-flat tubing being allocated accordingly. As a further alternative where it is desired to thicken both panels of the bag, sinuous folding of the fused segment first proceeds on one side of the bag and then on the other side of the bag after a fold around the bag bottom. In both these multiple-thickened embodiments, of course the appropriate portions of the external surface of the lay-flat tubing must be pretreated for self-adherence.

Figure 2:
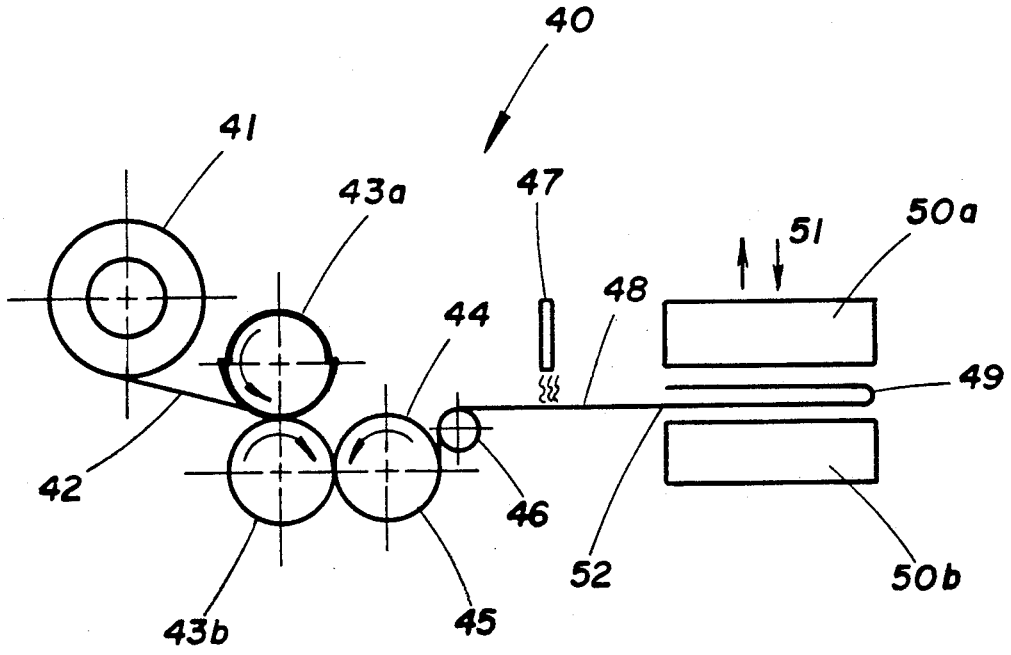
FIG. 2 is a schematic flow chart of a preferred method for making the foregoing bag.

In FIG. 2, there is shown a schematic flow chart of a preferred method for making bags of the invention in a continuous operation. Process 40 starts with the provision of roll 41 of lay-flat tubular film which is fed out at 42 into the nip of heated embossing rolls **43*a,b*. Embossing roll 43*a* has a raised portion along its rolling surface, the arc length corresponding to the length of fused segments along lay-flat tubing 42. The arc length of the unraised rolling surface of roll 43*a* corresponds to the unfused interval along lay flat tube 42 lying between fused segments. Thus, under the heated pressing in the nip of embossing rolls 43*a,b* the internal surface of the lay-flat tubing 42, being heat sealable, fuses. The advancing lay-flat tubing upon exiting the nip of the embossing rolls is then directed under chill roll 44 as indicated at 45 to quench the fused internal surface of the lay-flat tubing. The advancing embossed tubing is directed over guide roll 46 into the field of conventional corona discharge unit 47 whereby one exterior surface of the advancing lay-flat tubing is rendered self-adherent upon exiting the corona field at 48. The tubing is then folded at the juncture between the leading fused-unfused segments back onto itself so that the self-adherent treated surface is folded into itself. Folding at leading junction 49 between fused-unfused portions is accomplished by a conventional tucking operation (not shown), which preferably is of the type that operates by directing the advancing film across the opening between the open jaws of the reciprocating press 50 and then directing an air jet against the film so as to stuff the film into the press in a U-folded configuration. The folded portion of the tubing is then compressed between reciprocating press jaws 50*a,b* operating in the direction indicated by arrows 51. The pressing unifies adjacent self-adherent surfaces of the lay-flat tubing. The folded and pressed portion is then severed at 52** from the remainder of the advancing tubing thereby to form a bag as depicted above.

Figure 3:
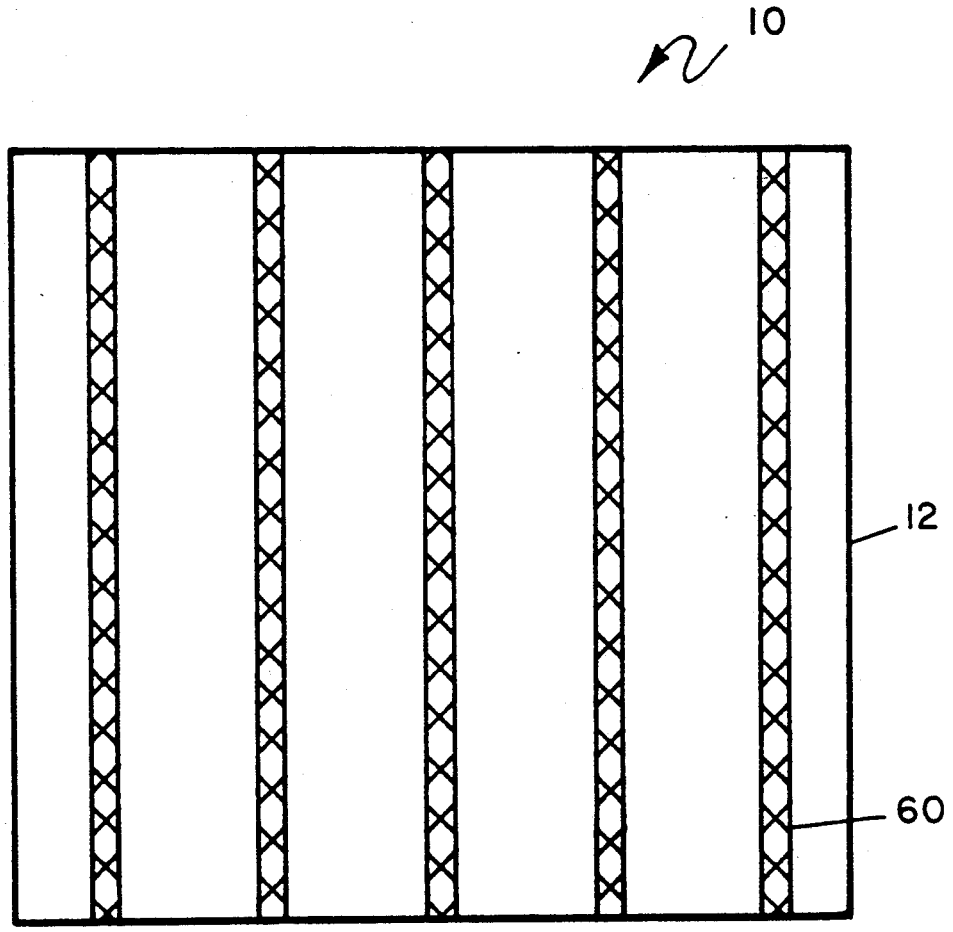
FIG. 3 is a schematic plan view of another preferred bone puncture resistant bag in accordance with the present invention.

As an optional feature concerning embossing roll **43*a*, the embossing surface may be patterned to fuse longitudinal strips 60 along the tubing, as compared to an unpatterned embossing surface which would cause complete interfacial bonding along the internal surfaces of the collapsed tubing (See FIG. 3**). The advantage of such a striated embossed fusing pattern is that the final bag product is of relatively increased flexibility.

In a less preferred variant of the invention, a similarly reinforced bag is provided but which has either an end-seal or side-seals and therefore is not seamless; however, this alternate bag construction is particularly suited when it is desired to make a series of bags. The bag construction includes a length of lay-flat tubular film folded along its longitudinal axis and having all adjacent film surfaces interfacially bonded, respectively, except at one outermost interface, the tube being sealed at one end or sealed at both ends with a cut along the collapsed edge of the lay-flat tube which is adjacent the unbonded interface. In making a series of such bags, a conventional bag making operation is modified by first fusing the internal surfaces of lay-flat tubing to one side of its longitudinal axis and treating one exterior face of the lay-flat tubing for self-adherence as above. Then the treated tubing is folded along its longitudinal axis toward its adherently treated surface. The thus modified lay-flat tubing is then directed to a conventional bag making operation for either end-sealed or side-sealed bags. In making a series of end-sealed bags, the prepared lay-flat tubing is transversely heat-sealed and perforated at regular intervals along the tubing, the transverse seals forming the bag ends and the lines of perforation providing a convenient means of separating the bags. In making a series of side-sealed bags, the prepared lay-flat tubing is transversely heat-sealed at regular intervals along the tubing, the transverse seals forming the bag sides. The bag mouth is provided by cutting along the collapsed edge of the lay-flat tubing which is adjacent the unbonded interface, i.e. the interface which delimits the product containing envelope of the bag.

Although the present invention has been described in conjunction with preferred embodiments, it is to be understood that modifications and variations may be utilized without departing from the principles and scope of the invention, as those skilled in the art will readily understand. Accordingly, such modifications and variations may be practiced within the scope of the following claims:

What is claimed is:

1. A seamless, puncture-resistant thermoplastic bag comprising:

(a) a first panel comprising one layer of thermoplastic film;

(b) a second panel approximately equal in length to said first panel, and comprising three layers of thermoplastic film;

(c) said first and second panels adjoining at seamless bottom and side portions of said bag;

(d) an envelope defined by said first and second panels, and suitable for containing a meat product having bone sections; and (e) said three layers of said second panel comprising respectively an outer layer, an intermediate layer, and an inner layer, adjacent surfaces of the outer and intermediate layers being interfacially bonded, and adjacent surfaces of the intermediate and inner layers being interfacially bonded.

2. The bag of claim 1 further comprising an extended closure lip.

* * * * *